US010059906B2

(12) United States Patent
Jiang et al.

(10) Patent No.: US 10,059,906 B2
(45) Date of Patent: Aug. 28, 2018

(54) SOLVENTLESS WINTERIZATION OF MICROBIAL OIL

(71) Applicant: Mara Renewables Corporation, Dartmouth (CA)

(72) Inventors: Xuan Jiang, Dartmouth (CA); Dorothy Dennis, Dartmouth (CA); Roberto E. Armenta, Dartmouth (CA)

( * ) Notice: Subject to any disclaimer, the term of this patent is extended or adjusted under 35 U.S.C. 154(b) by 0 days.

(21) Appl. No.: 15/655,433

(22) Filed: Jul. 20, 2017

(65) Prior Publication Data

US 2018/0023032 A1 Jan. 25, 2018

Related U.S. Application Data

(60) Provisional application No. 62/364,367, filed on Jul. 20, 2016.

(51) Int. Cl.
*C11B 7/00* (2006.01)

(52) U.S. Cl.
CPC ..... *C11B 7/0075* (2013.01)

(58) Field of Classification Search
CPC ..... C11B 7/0075; C11B 3/006; C07C 7/14; C07C 7/10; C12P 7/64
See application file for complete search history.

(56) References Cited

U.S. PATENT DOCUMENTS 3,048,491 A * 8/1962 Gooding ..... C11B 7/0075 426/313
4,447,462 A 5/1984 Tafuri et al.
5,340,594 A 8/1994 Barclay
5,340,742 A 8/1994 Barclay
5,441,738 A * 8/1995 Klein ..... C11B 7/0075 426/601
6,607,900 B2 8/2003 Bailey et al.
8,034,391 B2 * 10/2011 Abril ..... A23D 9/013 426/417
8,163,515 B2 4/2012 Burja et al.
2002/0026063 A1 * 2/2002 Luthria ..... C11B 1/025 554/174

(Continued)

OTHER PUBLICATIONS

PCT/IB2017/054412 , "PCT Search Report", dated Nov. 21, 2017, 7 pages.

(Continued)

*Primary Examiner* — Yate' K Cutliff
(74) *Attorney, Agent, or Firm* — Kilpatrick Townsend & Stockton, LLP

(57) ABSTRACT

Provided herein are methods for winterizing oil. The methods include heating the oil to a first temperature and maintaining the oil at the first temperature for a first period of time; reducing the first temperature of the oil after the first period of time to a second temperature over a second period of time, wherein reducing the first temperature produces a first solid fraction and first liquid fraction of the oil; removing the first solid fraction from the oil; reducing the second temperature of the first liquid fraction of the oil over a third period of time to a third temperature, wherein reducing the second temperature of the oil produces a second solid fraction and second liquid fraction of the oil; removing the second solid fraction from the oil; and recovering the second liquid fraction of the oil.

31 Claims, 2 Drawing Sheets

(56) References Cited

U.S. PATENT DOCUMENTS

| | | | | |
|---|---|---|---|---|
| 2009/0099260 | A1* | 4/2009 | Namal Senanayake | A21D 2/165 514/560 |
| 2009/0117194 | A1 | 5/2009 | Burja et al. | |
| 2012/0119862 | A1* | 5/2012 | Franklin | A23D 9/007 336/58 |
| 2012/0244584 | A1 | 9/2012 | Zhang et al. | |
| 2014/0323569 | A1 | 10/2014 | Raman | |
| 2015/0176042 | A1 | 6/2015 | Dennis et al. | |
| 2016/0060565 | A1* | 3/2016 | Perez | C10M 175/005 508/111 |

OTHER PUBLICATIONS

Kreulen H.P., 1976. Fractionation and winterization of edible fats and oils. J. Am. Oil Chemists' Soc. (1976) 53:393-396.

* cited by examiner

SOLVENTLESS WINTERIZATION OF MICROBIAL OIL

CROSS-REFERENCE TO RELATED APPLICATION

This application claims priority to U.S. Provisional Application No. 62/364,367, filed Jul. 20, 2016, which is incorporated by reference herein in its entirety.

BACKGROUND

Polyunsaturated fatty acids (PUFA), more specifically the omega-3 fatty acids, which include docosahexaenoic acid (DHA), provide numerous health benefits. With the development of biotechnology, these fatty acids can be produced efficiently by microorganisms as an alternative source to fish. Microbial lipids, however, do not always have the physical properties required for handling and are prone to phase separation. A typical process for removal of solids from microbial lipids by controlled crystallization involves solvents if crystallizing a desired fraction or dry fractionation by winterizing or pressing. However, solvents are expensive and impact process safety, and dry fractionation methods result in a large amount of solids removed, thereby, resulting in a poor liquid oil yield. Typical methods for obtaining liquid oils from solid fat with the desired composition of fatty acids are problematic for large scale production.

BRIEF SUMMARY

Provided herein are methods for winterizing oil. The methods include heating the oil to a first temperature and maintaining the oil at the first temperature for a first period of time; reducing the first temperature of the oil after the first period of time to a second temperature over a second period of time, wherein reducing the first temperature produces a first solid fraction and first liquid fraction of the oil; removing the first solid fraction from the oil; reducing the second temperature of the first liquid fraction of the oil over a third period of time to a third temperature, wherein reducing the second temperature of the oil produces a second solid fraction and second liquid fraction of the oil; removing the second solid fraction from the oil; and recovering the second liquid fraction of the oil. The method can be carried out in the absence of solvent to result in an optimized winterized oil having desired physical properties and composition of fatty acids.

DETAILED DESCRIPTION

Figure 1:
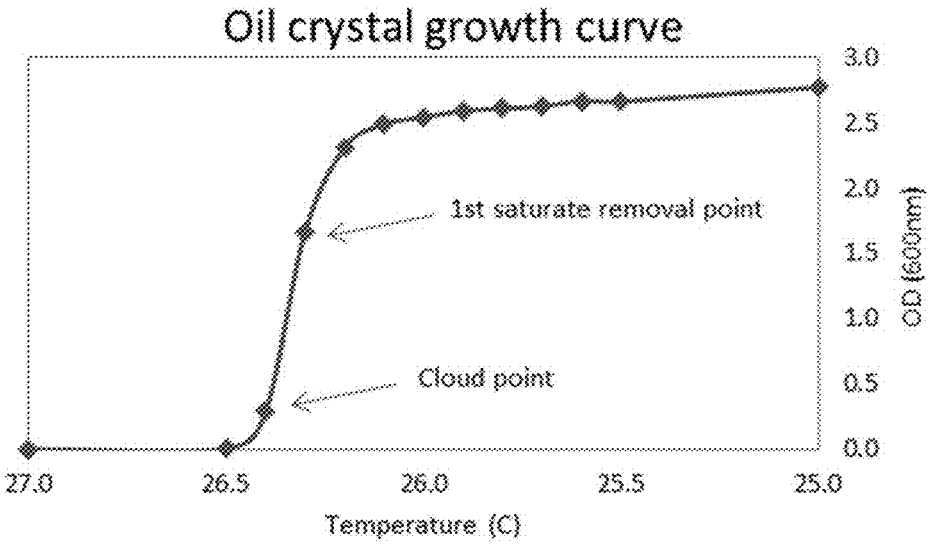
FIG. 1 is a graph showing the crystal grown in oil as a function of temperature.

Normally after oil is extracted, the oil becomes cloudy at ambient conditions due to its complex fatty acid composition. A refining process called winterization is generally required to remove saturated components that contribute to the cloudiness. Since algal oils crystallize and solidify within a small temperature window (less than 10° C.), solvents are generally used to offset the increasing viscosity of the oil mixture to achieve the desired separation of solids from the liquid oil. When solvents are absent, it leads to either low yield of the liquid fraction or completely inseparable oil. However, for optimized food safety, alternatives to the use of solvents are preferred. To date, such alternatives have failed to provide a commercially viable option due to separation challenges. The challenge of such treatments of algal oil, for example, lies in the large amount of solid fraction that traps liquid oil hampering separation. The present methods, in contrast, provide a physical fractionation process that produce clear oil in its natural form (without degradation of triglycerides) at ambient temperature through stepwise temperature adjustment and control to achieve separation. As described herein, the fractionation process is divided into stages, solids are removed promptly and efficiently without removing too much liquid oil. Improved access to and recovery of the liquid fraction enhances total yield. Thus, the winterized liquid oil produced by the herein provided methods optionally has a high DHA content.

Provided herein is a method for winterizing oil comprising the steps of providing an oil, heating the oil to a first temperature and maintaining the oil at the first temperature for a first period of time, reducing the first temperature of the oil after the first period of time to a second temperature over a second period of time, wherein reducing the first temperature produces a solid fraction and liquid fraction of the oil, removing the solid fraction and recovering the liquid fraction of the oil thereby obtaining winterized oil. Optionally, the method is carried out in the absence of solvents. Optionally, the method consists essentially of providing an oil, heating the oil to a first temperature and maintaining the oil at the first temperature for a first period of time, reducing the first temperature of the oil after the first period of time to a second temperature over a second period of time, wherein reducing the first temperature produces a solid fraction and liquid fraction of the oil, and removing the solid fraction and recovering the liquid fraction of the oil thereby obtaining winterized oil.

Also provided herein is a high-yield solventless winterization method involving at least a two-stage dry fractionation process that refines crude oils made by microorganisms into clear oils that flow at room temperature. This process is a temperature-controlled winterization of the crude oil, during which solid fractions are removed at least twice. The first fraction removal is conducted soon after crystallization occurs, which can be determined by the oil's optical density. The resulting liquid fraction continues the winterization process until crystals appear at a lower temperature. The crystals are then removed at the targeted temperature. The fractionation process uses no organic solvents. The two-stage process provides a high yield and elevated DHA content comparable to solvent-assisted winterization and much higher yield than one-stage dry fractionation. For example, the two-stage process increases the DHA content in the final oil product. The provided methods for winterizing oil include the steps of providing an oil; heating the oil to a first temperature and maintaining the oil at the first temperature for a first period of time; reducing the first temperature of the oil after the first period of time to a second temperature over a second period of time, wherein reducing the first temperature produces a first solid fraction and first liquid fraction of the oil; removing the first solid fraction from the oil; reducing the second temperature of the first liquid fraction of the oil over a third period of time to a third temperature, wherein reducing the second temperature of the oil produces a second solid fraction and second liquid fraction of the oil; removing the second solid fraction from the oil; and recovering the second liquid fraction of the oil. The second liquid fraction comprises the winterized oil. Optionally, the method is carried out in the absence of solvents. Optionally, the oil is filtered prior to heating the oil to the first temperature to remove impurities. Optionally, a filter aid, such as diatomaceous earth, is added to the oil.

Optionally, the winterized oil is clear at room temperature. As used herein, the term clear or clear oil refers to an oil that is transparent (i.e., not cloudy), which allows light to pass through the oil. The term clear is not intended to imply that the oil must be free of color as an oil that is clear may also have a color, i.e., orange or yellow.

Optionally, the winterized oil comprises one or more polyunsaturated fatty acids (e.g., docosahexaenoic acid (DHA). The total lipids in the oil comprise, for example, 40% or more DHA. Optionally, the total lipids in the oil comprise 35 to 45% DHA.

In the provided methods, the first temperature is, optionally, above the melting point of the oil. As used herein, the term melting point refers to the temperature at which the oil becomes clear. The oil is in a liquid state at or above the melting point. Optionally, the first temperature is above the melting point, for example, from about 25° C. to 65° C., from about 40° C. to 65° C., or any temperature within these ranges. These temperatures can be determined by known methods including those established by the American Oil Chemistry Society (AOCS) and American Society of Testing and Materials (ASTM), which establishes specifications for determining the melting, cloud and pour points of fluids such as lipids and oils. For example, the melting point can be determined using AOCS Official Method Cc 1-25, cloud point can be determined using AOCS Official Method Cc 6-25, and pour point can be determined using ASTM Official Method D97.

The oil is maintained at the first temperature for a selected period of time. Optionally, the oil is maintained at the first temperature for 1 to 60 minutes or more. Optionally, the oil is maintained at the first temperature for at least about 5 minutes.

In the provided methods, the first temperature is reduced over the second period of time to a second temperature. Optionally, the first temperature is reduced by 0.5 to 2 degrees per hour over the second period of time to reach the second temperature. The temperature can be reduced by 0.5, 0.6, 0.7, 0.8, 0.9, 1.0, 1.1, 1.2, 1.3, 1.4, 1.5, 1.6, 1.7, 1.8, 1.9 or 2 degrees per hour over the second period of time. The second period of time is selected, for example, from 1 to 10 hours, for 1, 2, 3, 4, 5, 6, 7, 8, 9, 10 hours, or for any period of time in between. Optionally, the temperature is reduced by 1 degree per hour over the second period of time.

The oil can be agitated during the second period of time by stirring, mixing, blending, shaking, vibrating, or a combination thereof. Optionally, the oil is mixed during the second period of time at a mixing speed of 50 to 200 rpm or any amount in between 50 and 200 rpm.

In the provided methods, the second temperature is at or near the cloud point of the oil. As used herein, the term cloud point refers to the temperature of the oil at which the oil begins to crystalize. One of skill in the art recognizes or knows how at measure and assess the cloud point of an oil. For example, the cloud point can be routinely determined by the cloud point test, e.g. AOCS Official Method Cc 6-25. Optionally, the second temperature is between about 10° C. to about 20° C., between about 20° C. to about 30° C., or any value within these ranges.

Optionally, the oil is maintained at the second temperature for about 1 to 30 minutes or 1, 2, 3, 4, 5, 6, 7, 8, 9, 10, 11, 12, 13, 14, 15, 16, 17, 18, 19, 20, 21, 22, 23, 24, 25, 26, 27, 28, 29 or 30 minutes. For example, the oil is maintained at the second temperature for 5 to 20 minutes. Optionally, the second temperature is reduced by about 0.5 to 2 degrees per hour over the third period of time to the third temperature. For example, the temperature is reduced by 0.5, 0.6, 0.7, 0.8, 0.9, 1.0, 1.1, 1.2, 1.3, 1.4, 1.5, 1.6, 1.7, 1.8, 1.9 or 2 degrees per hour over the third period of time of about 1, 2, 3, 4, 5, 6, 7, 8, 9, or 10 hours.

The third temperature is optionally about room temperature. Optionally, the third temperature is about 3-5° C. or about 4° C.

Optionally, the provided methods further comprise reducing the third temperature of the second liquid fraction of the oil over a fourth period of time to a fourth temperature, wherein reducing the third temperature of the oil produces a third solid fraction and third liquid fraction of the oil. Optionally, the method further comprises removing the third solid fraction of the oil. Optionally, the method further comprises recovering the third liquid fraction of the oil (i.e., the winterized oil). Optionally, the fourth temperature is about room temperature. Optionally, the fourth temperature is about 3-5° C. or about 4° C.

In the provided methods, the solid fractions of the oil can be removed by any one or more means including, but not limited to, filtration and centrifugation.

Optionally, the oil to be winterized comprises triglycerides. More specifically, the oil can comprise alpha linolenic acid, arachidonic acid, docosahexanenoic acid, docosapentaenoic acid, eicosapentaenoic acid, gamma-linolenic acid, linoleic acid, linolenic acid, or any combination thereof. Optionally, the oil to be winterized comprises triglycerides. Optionally, the oil comprises fatty acids selected from the group consisting of palmitic acid (C16:0), myristic acid (C14:0), palmitoleic acid (C16:1(n-7)), cis-vaccenic acid (C18:1(n-7)), docosapentaenoic acid (C22:5(n-6)), docosahexaenoic acid (C22:6(n-3)), and any combination thereof.

Oil that is processed using the provided methods can be obtained from a variety of sources such as fish, vegetables, or microorganisms. The oil can be derived from a population of microorganisms, e.g., oil-producing algae, fungi, bacteria and protists. Optionally, the oil is a plant seed oil. The population of microorganisms is optionally selected from the genus *Oblongichytrium, Aurantiochytrium Thraustochytrium*, and *Schizochytrium* or any mixture thereof. Optionally, the microorganism is Thraustochytrids of the order Thraustochytriales, more specifically Thraustochytriales of the genus *Thraustochytrium*. Exemplary microorganisms include Thraustochytriales as described in U.S. Pat. Nos. 5,340,594 and 5,340,742, which are incorporated herein by reference in their entireties. The microorganism can be a *Thraustochytrium* species, such as the *Thraustochytrium* species deposited as ATCC Accession No. PTA-6245 (i.e., ONC-T18), as described in U.S. Pat. No. 8,163,515, which is incorporated by reference herein in its entirety.

Microalgae are acknowledged in the field to represent a diverse group of organisms. For the purpose of this document, the term microalgae is used to describe unicellular microorganisms derived from aquatic and/or terrestrial environments (some cyanobacteria are terrestrial/soil dwelling). Aquatic environments extend from oceanic environments to freshwater lakes and rivers, and also include brackish environments such as estuaries and river mouths. Microalgae can be photosynthetic; optionally, microalgae are heterotrophic. Microalgae can be of eukaryotic nature or of a prokaryotic nature. Microalgae can be non-motile or motile.

The term thraustochytrid, as used herein, refers to any member of the order Thraustochytriales, which includes the family Thraustochytriaceae. Strains described as thraustochytrids include the following organisms: Order: Thraustochytriales; Family: Thraustochytriaceae; Genera: *Thraustochytrium* (Species: sp., *arudimentale, aureum, benthicola, globosum, kinnei, motivum, multirudimentale, pachydermum, proliferum, roseum, striatum*), *Ulkenia* (Species: sp., *amoeboidea, kerguelensis, minuta, profunda, radiata, sailens, sarkariana, schizochytrops, visurgensis, yorkensis*), *Schizochytrium* (Species: sp., *aggregatum, limnaceum, mangrovei, minutum, octosporuni*), *Japonochytrium* (Species: sp., *marinum*), *Aplanochytrium* (Species: sp., *haliotidis, kerguelensis, profunda, stocchinoi*), *Althornia* (Species: sp., *crouchii*), or *Elina* (Species: sp., *marisalba, sinorifica*). Species described within *Ulkenia* are considered to be members of the genus *Thraustochytrium*. Strains described as being within the genus *Thrautochytrium* may share traits in common with and also be described as falling within the genus *Schizochytrium*. For example, in some taxonomic classifications ONC-T18 may be considered within the genus *Thrautochytrium*, while in other classifications it may be described as within the genus *Schizochytrium* because it comprises traits indicative of both genera.

The provided methods include or can be used in conjunction with additional steps for culturing microorganisms according to methods known in the art and obtaining the oil therefrom. For example, a Thraustochytrid, e.g., a *Thraustochytrium* sp., can be cultivated according to methods described in U.S. Patent Publications 2009/0117194 or 2012/0244584, which are herein incorporated by reference in their entireties for each step of the methods or compositions used therein.

To isolate oil from microorganisms, the microorganisms are grown in a growth medium (also known as culture medium). Any of a variety of media are suitable for use in culturing the microorganisms described herein. Optionally, the medium supplies various nutritional components, including a carbon source and a nitrogen source, for the microorganism. Medium for Thraustochytrid culture can include any of a variety of carbon sources. Examples of carbon sources include fatty acids (e.g., oleic acid), lipids, glycerols, triglycerols, carbohydrates, polyols, amino sugars, and any kind of biomass or waste stream. Carbohydrates include, but are not limited to, glucose, cellulose, hemicellulose, fructose, dextrose, xylose, lactulose, galactose, maltotriose, maltose, lactose, glycogen, gelatin, starch (corn or wheat), acetate, m-inositol (e.g., derived from corn steep liquor), galacturonic acid (e.g., derived from pectin), L-fucose (e.g., derived from galactose), gentiobiose, glucosamine, alpha-D-glucose-1-phosphate (e.g., derived from glucose), cellobiose, dextrin, alpha-cyclodextrin (e.g., derived from starch), and sucrose (e.g., from molasses). Polyols include, but are not limited to, maltitol, erythritol, and adonitol. Amino sugars include, but are not limited to, N-acetyl-D-galactosamine, N-acetyl-D-glucosamine, and N-acetyl-beta-D-mannosamine.

Optionally, the microorganisms provided herein are cultivated under conditions that increase biomass and/or production of a compound of interest (e.g., oil or total fatty acid (TFA) content). Thraustochytrids, for example, are typically cultured in saline or salt-containing medium. The culture medium optionally includes NaCl or natural or artificial sea salt and/or artificial seawater.

Thraustochytrids can be cultured, for example, in medium having a salt concentration from about 0.5 g/L to about 50.0 g/L, from about 0.5 g/L to about 35 g/L, or from about 18 g/L to about 35 g/L. Optionally, the Thraustochytrids described herein can be grown in low salt conditions (e.g., salt concentrations from about 0.5 g/L to about 20 g/L or from about 0.5 g/L to about 15 g/L).

Alternatively, the culture medium for Thraustochytrids, for example, can include non-chloride-containing sodium salts as a source of sodium, with or without NaCl. Examples of non-chloride sodium salts suitable for use in accordance with the present methods include, but are not limited to, soda ash (a mixture of sodium carbonate and sodium oxide), sodium carbonate, sodium bicarbonate, sodium sulfate, and mixtures thereof. See, e.g., U.S. Pat. Nos. 5,340,742 and 6,607,900, the entire contents of each of which are incorporated by reference herein. A significant portion of the total sodium, for example, can be supplied by non-chloride salts such that less than about 100%, 75%, 50%, or 25% of the total sodium in culture medium is supplied by sodium chloride.

Media for Thraustochytrid cultures can include any of a variety of nitrogen sources. Exemplary nitrogen sources include ammonium solutions (e.g., $NH_4$ in $H_2O$), ammonium or amine salts (e.g., $(NH_4)_2SO_4$, $(NH_4)_3PO_4$, $NH_4NO_3$, $NH_4OOCH_2CH_3$ ($NH_4Ac$)), peptone, tryptone, yeast extract, malt extract, fish meal, sodium glutamate, soy extract, casamino acids and distiller grains. Concentrations of nitrogen sources in suitable medium typically range between and including about 1 g/L and about 25 g/L.

The medium optionally includes a phosphate, such as potassium phosphate or sodium-phosphate. Inorganic salts and trace nutrients in medium can include ammonium sulfate, sodium bicarbonate, sodium orthovanadate, potassium chromate, sodium molybdate, selenous acid, nickel sulfate, copper sulfate, zinc sulfate, cobalt chloride, iron chloride, manganese chloride calcium chloride, and EDTA. Vitamins such as pyridoxine hydrochloride, thiamine hydrochloride, calcium pantothenate, p-aminobenzoic acid, riboflavin, nicotinic acid, biotin, folic acid and vitamin B12 can be included.

The pH of the medium can be adjusted to between and including 3.0 and 10.0 using acid or base, where appropriate, and/or using the nitrogen source. Optionally, the medium is sterilized.

Generally a medium used for culture of a microorganism is a liquid medium. However, the medium used for culture of a microorganism can be a solid medium. In addition to carbon and nitrogen sources as discussed herein, a solid medium can contain one or more components (e.g., agar or agarose) that provide structural support and/or allow the medium to be in solid form.

The resulting biomass can be pasteurized to inactivate undesirable substances present in the biomass. For example, the biomass can be pasteurized to inactivate compound degrading substances, such as degradative enzymes. The biomass can be present in the fermentation medium or isolated from the fermentation medium for the pasteurization step. The pasteurization step can be performed by heating the biomass and/or fermentation medium to an elevated temperature. For example, the biomass and/or fermentation medium can be heated to a temperature from about 50° C. to about 140° C. (e.g., from about 55° C. to about 90° C. or from about 65° C. to about 80° C.).

Optionally, the biomass and/or fermentation medium can be heated from about 30 minutes to about 120 minutes (e.g., from about 45 minutes to about 90 minutes, or from about 55 minutes to about 75 minutes). The pasteurization can be performed using a suitable heating means, such as, for example, by direct steam injection.

The biomass can be harvested according to a variety of methods, including those currently known to one skilled in the art. For example, the biomass can be collected from the fermentation medium using, for example, centrifugation (e.g., with a solid-ejecting centrifuge) and/or filtration (e.g., cross-flow filtration). Optionally, the harvesting step includes use of a precipitation agent for the accelerated collection of cellular biomass (e.g., sodium phosphate or calcium chloride).

The biomass is optionally washed with water. The biomass can be concentrated up to about 30% solids. For example, the biomass can be concentrated to about 1% to about 20% solids, from about 5% to about 20%, from about 7.5% to about 15% solids, or to any percentage within the recited ranges.

Prior to winterization, the oil or polyunsaturated fatty acids are obtained or extracted from the biomass or microorganisms using one or more of a variety of methods, including those currently known to one of skill in the art. For example, methods of isolating oil or polyunsaturated fatty acids are described in U.S. Pat. No. 8,163,515, which is incorporated by reference herein in its entirety. Alternatively, the oil or polyunsaturated fatty acids are isolated as described in U.S. Publication No. 2015-0176042, which is incorporated by reference herein in its entirety. Optionally, the one or more polyunsaturated fatty acids are selected from the group consisting of alpha linolenic acid, arachidonic acid, docosahexanenoic acid, docosapentaenoic acid, eicosapentaenoic acid, gamma-linolenic acid, linoleic acid, linolenic acid, and any combination thereof.

Winterized oil or derivatives thereof (e.g., polyunsaturated fatty acids (PUFAs) and other lipids) can be utilized in any of a variety of applications exploiting their biological, nutritional, or chemical properties. Thus, the winterized oil or derivatives thereof can be used to produce biofuel. Optionally, the oil is used in pharmaceuticals, nutraceuticals, food supplements, animal feed additives, cosmetics, and the like.

Optionally, the liquid fractions of oil or the solid fractions of oil produced according to the methods described herein can be incorporated into a final product (e.g., a food or feed supplement, an infant formula, a pharmaceutical, a fuel, and the like). Optionally, the solid fractions are incorporated into animal feed. Optionally, the liquid fractions are incorporated into a food supplement, e.g., a nutritional or dietary supplement such as a vitamin. Suitable food or feed supplements into which the lipids can be incorporated include beverages such as milk, water, sports drinks, energy drinks, teas, and juices; confections such as candies, jellies, and biscuits; fat-containing foods and beverages such as dairy products; processed food products such as soft rice (or porridge); infant formulae; breakfast cereals; or the like.

Optionally, one or more of the winterized oils or compounds therein (e.g., PUFAs) can be incorporated into a nutraceutical or pharmaceutical product or a cosmetic. Examples of such a nutraceuticals or pharmaceuticals include various types of tablets, capsules, drinkable agents, etc. Optionally, the nutraceutical or pharmaceutical is suitable for topical application, e.g., as a lotion or ointment. Dosage forms can include, for example, capsules, oils, granula, granula subtilae, pulveres, tabellae, pilulae, trochisci, or the like.

The winterized oil or lipids portions thereof produced according to the methods described herein can be incorporated into products as described herein in combination with any of a variety of other agents. For instance, such compounds can be combined with one or more binders or fillers, chelating agents, pigments, salts, surfactants, moisturizers, viscosity modifiers, thickeners, emollients, fragrances, preservatives, etc., or any combination thereof.

All ranges as recited herein include each and every value or fractional value within the range and are inclusive of their end points.

Disclosed are materials, compositions, and components that can be used for, can be used in conjunction with, can be used in preparation for, or are products of the disclosed methods and compositions. These and other materials are disclosed herein, and it is understood that when combinations, subsets, interactions, groups, etc. of these materials are disclosed that while specific reference of each various individual and collective combinations and permutations of these compounds may not be explicitly disclosed, each is specifically contemplated and described herein. For example, if a method is disclosed and discussed and a number of modifications that can be made to a number of molecules including the method are discussed, each and every combination and permutation of the method, and the modifications that are possible are specifically contemplated unless specifically indicated to the contrary. Likewise, any subset or combination of these is also specifically contemplated and disclosed. This concept applies to all aspects of this disclosure including, but not limited to, steps in methods using the disclosed compositions. Thus, if there are a variety of additional steps that can be performed, it is understood that each of these additional steps can be performed with any specific method steps or combination of method steps of the disclosed methods, and that each such combination or subset of combinations is specifically contemplated and should be considered disclosed.

Publications cited herein and the material for which they are cited are hereby specifically incorporated by reference in their entireties.

The examples below are intended to further illustrate certain aspects of the methods and compositions described herein, and are not intended to limit the scope of the claims.

EXAMPLES

Example 1

Solvent Winterization

All experimental oil was obtained from standard cultivation of ONC-T18 on glucose and subsequent enzymatic hydrolysis. Solvent winterization uses organic solvents, e.g. hexane, acetone, to assist oil fractionation. In this experiment, oil samples (duplicates of 20 g oil each) were dissolved in hexane with solvent to oil ratios of 2:1, 1:1 and 0.5:1. To obtain clear oil at room temperature, i.e., 20° C., fractionation temperature was lowered to 10° C. and kept there overnight. Liquid oil fractions were recovered by centrifugation (4600 rpm×20 min) and removal of solvent by evaporation at ambient conditions. Yield was calculated based on the weight of liquid fraction over the total weight of starting oil. DHA content was analyzed based on FAME analysis by gas chromatography (Table 1).

TABLE 1

| Results of Solvent Winterization | | |
|---|---|---|
| Solvent to oil ratio | Yield of liquid fraction (%) | DHA in liquid fraction (%)* |
| 2:1 | 91.6 ± 1.4 | 41.8 |
| 1:1 | 83.8 ± 0.7 | 42.5 |
| 0.5:1 | 83.0 ± 0.6 | 42.6 |

*DHA content in starting oil is 40.9%

Example 2

One-stage Solventless Winterization

The same oil was used in this and subsequent experiments to compare with the result of above solvent winterization. Twenty 20 g of oil were melted at 50° C. for 30 minutes to eliminate its thermal history. It was then cooled to 1° C. above its cloud point (i.e., 26.4° C.) and kept cooling slowly at a controlled rate at 1° C./h until 20° C. was reached. The sample was kept at 20° C. overnight. Mixing was achieved by using a stir plate and a speed set to 60 rpm. The liquid oil fraction was recovered by vacuum filtration through Whatman® No. 1 filter paper (Maidstone, United Kingdom). Experiment was conducted with duplicate samples. 51.8% oil was recovered with a final DHA content of 43.3% (Table 2).

Example 3

Two-stage Solventless Winterization

The melted oil was cooled from 50° C. to 30° C. and further to 26.3° C. at a fixed rate of 1° C./h. The temperature was maintained at 26.3° C. for 12 minutes before saturates were removed by vacuum filtration. Thus obtained liquid fraction was subjected to a second stage of cooling at 1° C./h until it reached 20° C. As the two-stage solventless winterization separates the oil fractions at lower crystal contentrations (FIG. 1), it avoids high viscosity and big oil loss. A yield of 82.9% was achieved with DHA content at 43.0% (Table 2).

TABLE 2

| Solventless Winterization. | | |
|---|---|---|
| Dry fractionation | Yield of liquid fraction (%) | DHA in liquid fraction (%) |
| One-stage | 51.8 ± 0.7 | 43.3 |
| Two-stage | 82.9 ± 2.5 | 43.0 |

* DHA content in starting oil is 40.9%.

Example 4

Two-stage Winterization at a Higher Cooling Rate

The experiment was carried out as in Example 3 except for using a higher cooling rate of 1.5° C./min. Saturates were separated from the liquid fraction by vacuum filtration. It resulted in a recovery yield of 65.1%, higher than that obtained in a one-stage solventless winterization (i.e., 51.8%), but lower than that in a two-stage solventless winterization (i.e., 82.9%), indicating a slower cooling rate is favorable to efficient phase separation although a faster cooling rate shortens the process greatly. The DHA content in final oil was 41.8%.

Example 5

Two-stage Winterization at a High Cooling Rate Followed by Centrifugal Concentration The experiment was carried out as in Example 4, e.g., cooling rate of 1.5° C./min, except that saturates were separated using Sartorius Vivaspin® 20 mL Centrifugal Concentrators (Littleton, Mass.) in a centrifuge at 4600 rpm for 20 min. The yield of oil was improved to 76.3%. The DHA content in final oil was 41.6%.

Example 6

Three-stage Solventless Winterization

Oil (440 g) was melted at 50° C. for 30 min to eliminate its thermal history. The winterization was performed at three stages. In the first stage, the oil was cooled at a rate of 1.5° C./min to its cloud point at 26.4° C. The oil was maintained at 26.4° C. for 12 min before phase separation by vacuum filtration. Such obtained liquid fraction was subjected to a second stage of cooling at a rate of 2° C./h until it reached 20° C. remaining at this temperature for half an hour. Saturates were then removed by vacuum filtration and the second liquid fraction was cooled in a third stage of winterization at 2° C./h until it reached 4° C.

Figure 2:
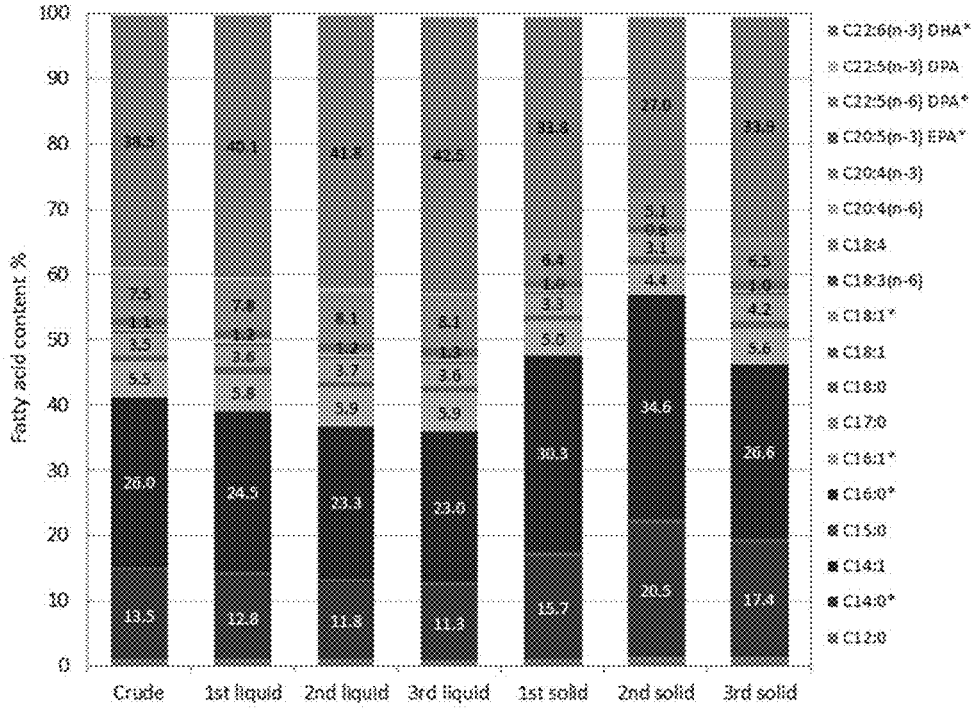
FIG. 2 is a bar graph showing the fatty acid profile of crude oil and its fractions during 3-stage solventless winterization. The chart contains fatty acid components with a content of 0.1% or higher in the oil. *Fatty acid component whose percentage is noted on the chart.

The yield and DHA content of each liquid fraction are shown in Table 3. The overall yield of the three-stage winterization was 60.8%. Winterization improved oil appearance and flow property. A clear oil at room temperature was obtained after the $2^{nd}$ stage fractionation. The oil also flowed after storing at 4° C. It was noted the crystallization in the $2^{nd}$ liquid when put under a temperature under 20° C. differed from that of the crude oil when put under its cloud point. When the crude oil was cooled, saturates came out and formed a solid layer below the liquid fraction. It was difficult to blend it into the liquid phase, which caused an oil loss after a certain period of storage. However, the crystals from the $2^{nd}$ liquid were loosely packed. They did not settle but were able to be mixed with the liquid fraction and poured out of the storage jar, which is desirable for storage and reuse. A $3^{rd}$ fractionation made the oil clear at 4° C. with a relatively high yield (i.e., 93.1%). A complete fatty acid profile is listed in Table 4 and major fatty acid components are shown in FIG. 2.

TABLE 3

| Three Stage Solventless Winterization | | | | |
|---|---|---|---|---|
| Fraction | Yield (%) | DHA (%) | Pour Point (° C.) | Form/Appearance |
| Crude Oil | — | 38.5 | 18 | Solid at 20° C. |
| $1^{st}$ Liquid | 74.5 | 40.1 | 0 | Flow at 20° C. |
| $2^{nd}$ Liquid | 87.6 | 41.8 | −3 | Clear at 20° C. |
| $3^{rd}$ Liquid | 93.1 | 42.5 | −6 | Clear at 4° C. |

TABLE 4

Fatty acid profiles of crude oil and fractions before and after the three-stage solventless winterization

| | Crude oil | 1st liquid | 2nd liquid | 3rd liquid | 1st solid | 2nd solid | 3rd solid |
|---|---|---|---|---|---|---|---|
| C10:0 | 0.1 | 0.1 | 0.1 | 0.1 | 0.1 | 0.1 | 0.1 |
| C12:0 | 1.0 | 1.0 | 1.0 | 0.9 | 1.0 | 1.3 | 1.5 |
| C13:0 | 0.0 | 0.0 | 0.0 | 0.0 | 0.1 | 0.1 | 0.1 |
| C14:0 | 13.5 | 12.8 | 11.8 | 11.3 | 15.7 | 20.5 | 17.4 |
| C14:1 | 0.1 | 0.2 | 0.1 | 0.1 | 0.1 | 0.1 | 0.1 |
| C15:0 | 0.4 | 0.4 | 0.4 | 0.4 | 0.5 | 0.5 | 0.5 |
| C16:0 | 26.0 | 24.5 | 23.3 | 23.0 | 30.3 | 34.6 | 26.6 |
| C16:1 | 5.5 | 5.8 | 5.9 | 5.9 | 5.0 | 4.4 | 5.6 |
| C17:0 | 0.1 | 0.1 | 0.1 | 0.1 | 0.1 | 0.1 | 0.1 |
| C18:0 | 0.7 | 0.7 | 0.6 | 0.6 | 0.9 | 1.0 | 0.8 |
| C18:1 Ole | 0.2 | 0.2 | 0.2 | 0.2 | 0.2 | 0.2 | 0.2 |
| C18:1 Vac | 3.5 | 3.6 | 3.7 | 3.6 | 3.3 | 3.1 | 4.2 |
| C18:3n-6 | 0.1 | 0.1 | 0.1 | 0.1 | 0.1 | 0.1 | 0.1 |
| C18:4 | 0.2 | 0.2 | 0.2 | 0.2 | 0.2 | 0.2 | 0.2 |
| C20:0 | 0.1 | 0.1 | 0.1 | 0.1 | 0.1 | 0.1 | 0.1 |
| C20:2 n-6 | 0.0 | 0.0 | 0.0 | 0.0 | 0.1 | 0.0 | 0.1 |
| C20:3 n-6 | 0.1 | 0.1 | 0.1 | 0.1 | 0.1 | 0.1 | 0.1 |
| C20:4 n-6 | 0.3 | 0.3 | 0.3 | 0.3 | 0.3 | 0.2 | 0.3 |
| 20:4n3 | 0.4 | 0.4 | 0.4 | 0.4 | 0.4 | 0.3 | 0.4 |
| C20:5 n-3 | 1.1 | 1.2 | 1.2 | 1.3 | 1.0 | 0.8 | 1.0 |
| C22:0 | 0.1 | 0.1 | 0.1 | 0.1 | 0.0 | 0.0 | 0.0 |
| C22:4 n-6 | 0.1 | 0.1 | 0.1 | 0.0 | 0.0 | 0.0 | 0.1 |
| C22:5 n-6 | 7.5 | 7.8 | 8.1 | 8.1 | 6.4 | 5.1 | 6.5 |
| 22:5 n-3 | 0.3 | 0.3 | 0.3 | 0.2 | 0.2 | 0.1 | 0.3 |
| C24:0 | 0.0 | 0.0 | 0.0 | 0.2 | 0.1 | 0.1 | 0.0 |
| C22:6 n-3 | 38.5 | 40.1 | 41.8 | 42.5 | 33.8 | 27.0 | 33.9 |

Example 7

One-stage Winterization

Figure 3:
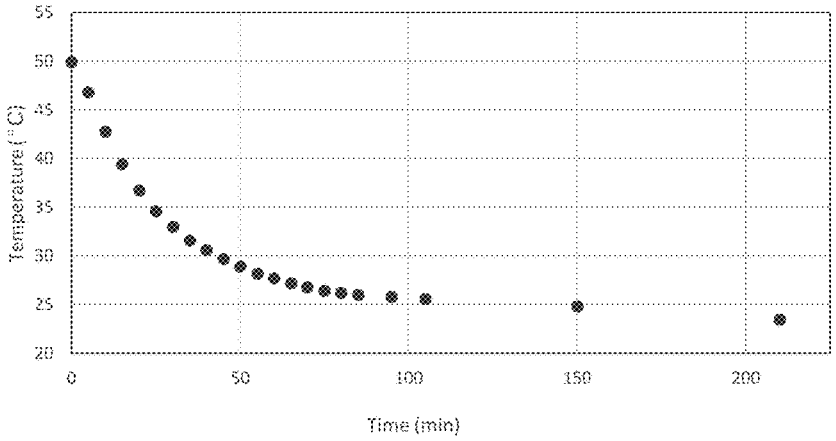
FIG. 3 is a graph showing the temperature change over time of a 45 mL oil sample during ambient cooling.

In this one-step ambient cooling process, oil was first heated to 50° C. for thirty minutes. Then the oil was placed at room temperature (20-21° C.) and cooled. The cooling rate varied as it was not controlled. The temperature drop was fast but gradually slowed down as can be seen in FIG. 3. Samples were stored at room temperature for 24 hours. Separation was achieved by vacuum filtration (11 μm) at room temperature. Examples of yield and change of DHA content are listed in Table 5.

TABLE 5

One-stage solventless winterization

| Sample # | Yield (%) | DHA in crude oil (%) | DHA in winterized oil (%) |
|---|---|---|---|
| 1 | 88.8 | 40.5 | 42.2 |
| 2 | 92.9 | 37.7 | 38.5 |
| 3 | 87.2 | 40.7 | 42.3 |

Example 8

Effects of Filter Aid and Filtration on Solventless Winterization

Crude oil was heated to 50° C. for 30 minutes before filtration (11 μm) to remove visible impurities. Filtered oil was thus obtained. Both crude and filtered oil were heated to 50° C. again for half hour and cooled at room temperature (20-21° C.) for 24 hours. Fractions were separated by vacuum filtration (11 μm) at room temperature. The yields of liquid fraction were compared but showed no significant difference between using crude and filtered oils (Table 3). Diatomaceous earth (filter aid) was added to both crude and filtered oil to repeat the same winterization conditions as above. The result showed that filter aid does not significantly impact yield (Table 6).

TABLE 6

Experiments on pre-filtration and using filter aid

| | Yield of liquid fraction from winterization conditions as below (%) | | | |
|---|---|---|---|---|
| Sample # | From crude oil | From filtered oil | From crude oil with filter aid | From filtered oil with filter aid |
| 1 | 93.0 | 92.0 | 93.5 | 93.1 |
| 2 | 80.2 | 83.7 | 78.8 | 82.8 |

What is claimed is:

1. A method for winterizing oil comprising the steps of:

(a) providing an oil;

(b) heating the oil to a first temperature and maintaining the oil at the first temperature for a first period of time;

(c) reducing the first temperature of the oil after the first period of time to a second temperature over a second period of time, wherein the first temperature is reduced by 0.5 to 2 degrees per hour over the second period of time to the second temperature, wherein reducing the first temperature produces a first solid fraction and first liquid fraction of the oil;

(d) removing the first solid fraction from the oil;

(e) reducing the second temperature of the first liquid fraction of the oil over a third period of time to a third temperature, wherein reducing the second temperature of the oil produces a second solid fraction and second liquid fraction of the oil, and wherein the oil is not heated between the steps of reducing the first temperature and reducing the second temperature;

(f) removing the second solid fraction from the oil; and (g) recovering the second liquid fraction of the oil.

2. The method of claim 1, wherein the method is carried out in the absence of solvents.

3. The method of claim 1, wherein the first temperature is above the melting point of the oil.

4. The method of claim 1, wherein the first temperature is from 25° C. to 65° C.

5. The method of claim 4, wherein the first temperature is from 40° C. to 65° C.

6. The method of claim 1, wherein the oil is maintained at the first temperature for 5 to 60 minutes prior to the reducing the oil to the second temperatures.

7. The method of claim 1, wherein the second period of time is 1, 2, 3, 4, 5, 6, 7, 8, 9, or 10 hours.

8. The method of claim 1, wherein the oil is mixed during the second period of time.

9. The method of claim 8, wherein the mixing comprises a speed of 50 to 200 rpm.

10. The method of claim 1, wherein the second temperature is a cloud point of the oil.

11. The method of claim 1, wherein the second temperature is between 10° C. to 20° C.

12. The method of claim 1, wherein the second temperature is between 20° C. to 30° C.

13. The method of claim 1, wherein the oil is maintained at the second temperature for 5 to 20 minutes.

14. A method for winterizing oil comprising the steps of:

(a) providing an oil;

(b) heating the oil to a first temperature and maintaining the oil at the first temperature for a first period of time;

(c) reducing the first temperature of the oil after the first period of time to a second temperature over a second period of time, wherein reducing the first temperature produces a first solid fraction and first liquid fraction of the oil;

(d) removing the first solid fraction from the oil;

(e) reducing the second temperature of the first liquid fraction of the oil over a third period of time to a third temperature, wherein the second temperature is reduced by 0.5 to 2 degrees per hour over the third period of time to the third temperature, wherein reducing the second temperature of the oil produces a second solid fraction and second liquid fraction of the oil, and wherein the oil is not heated between the steps of reducing the first temperature and reducing the second temperature;

(f) removing the second solid fraction from the oil; and (g) recovering the second liquid fraction of the oil.

15. A method for winterizing oil comprising the steps of:

(a) providing an oil;

(b) heating the oil to a first temperature and maintaining the oil at the first temperature for a first period of time;

(c) reducing the first temperature of the oil after the first period of time to a second temperature over a second period of time, wherein reducing the first temperature produces a first solid fraction and first liquid fraction of the oil;

(d) removing the first solid fraction from the oil;

(e) reducing the second temperature of the first liquid fraction of the oil over a third period of time to a third temperature, wherein the second temperature is reduced by 0.5 to 2 degrees per minute over the third period of time to the third temperature, wherein reducing the second temperature of the oil produces a second solid fraction and second liquid fraction of the oil, and wherein the oil is not heated between the steps of reducing the first temperature and reducing the second temperature;

(f) removing the second solid fraction from the oil; and (g) recovering the second liquid fraction of the oil.

16. The method of claim 1, wherein the third period of time is 1, 2, 3, 4, 5, 6, 7, 8, 9, or 10 hours.

17. The method of claim 1, wherein the third temperature is room temperature.

18. The method of claim 1, wherein the third temperature is 4° C.

19. The method of claim 1, wherein the method further comprises reducing the third temperature of the second liquid fraction of the oil over a fourth period of time to a fourth temperature, wherein reducing the third temperature of the oil produces a third solid fraction and third liquid fraction of the oil.

20. The method of claim 19, wherein the method further comprises removing the third solid fraction of the oil.

21. The method of claim 19, wherein the method further comprises recovering the third liquid fraction of the oil.

22. The method of claim 19, wherein the fourth temperature is room temperature.

23. The method of claim 19, wherein the fourth temperature is 4° C.

24. The method of claim 1, wherein 80% or more of the oil is clear at room temperature.

25. The method of claim 1, wherein the oil comprises one or more polyunsaturated fatty acids.

26. The method of claim 25, wherein the polyunsaturated fatty acid is docosahexaenoic acid (DHA).

27. The method of claim 26, wherein the oil comprises 40% or more DHA.

28. The method of claim 1, wherein the oil is derived from a population of microorganisms.

29. The method of claim 28, wherein the population of microorganisms is selected from the group consisting of algae, fungi, bacteria and protists.

30. The method of claim 28, wherein the population of microorganisms is selected from the genus *Oblongichytrium, Aurantiochytrium Thraustochytrium*, and *Schizochytrium* or any mixture thereof.

31. The method of claim 28, wherein the population of microorganisms is a *Thraustochytrium* sp. deposited as ATCC Accession No. PTA-6245.

* * * * *